US005577898A

United States Patent [19]

Lee

[11] Patent Number: 5,577,898

[45] Date of Patent: Nov. 26, 1996

[54] SUCTION MUFFLER ARRANGEMENT FOR A HERMETIC RECIPROCATING COMPRESSOR

[75] Inventor: Sung-Tae Lee, Suwon, Rep. of Korea

[73] Assignee: Samsung Electronics Co., Ltd., Suwon, Rep. of Korea

[21] Appl. No.: 620,847

[22] Filed: Mar. 20, 1996

[30] Foreign Application Priority Data

Jul. 27, 1995 [KR] Rep. of Korea ..... 95-22579

[51] Int. Cl.[6] ..... F04B 39/00

[52] U.S. Cl. ..... 417/312; 181/403; 62/296

[58] Field of Search ..... 417/312, 571, 417/902; 181/229, 403; 62/296

[56] References Cited

U.S. PATENT DOCUMENTS

| | | | |
|---|---|---|---|
| 4,911,619 | 3/1990 | Todescat et al. | 417/312 |
| 5,207,564 | 5/1993 | Fritchman | 417/312 |

FOREIGN PATENT DOCUMENTS

| | | | |
|---|---|---|---|
| 195486 | 9/1986 | European Pat. Off. | 417/312 |
| 176676 | 7/1988 | Japan | 417/312 |
| 176677 | 7/1988 | Japan | 417/312 |
| 3290072 | 12/1991 | Japan | 417/312 |

*Primary Examiner*—Timothy S. Thorpe
*Assistant Examiner*—Roland G. McAndrews, Jr.
*Attorney, Agent, or Firm*—Burns, Doane, Swecker & Mathis, L.L.P.

[57] ABSTRACT

A structurally improved reciprocating compressor is disclosed. The compressor has a base muffler which acts not only as a refrigerant suction pipe and gasket but also as an arrangement for preventing heat from being transferred to the input refrigerant. The base muffler is interposed between the valves and cylinder head. Due to the base muffler, neither the motor heat nor the compressing heat is transferred to the input refrigerant passing the suction pipe part of the base muffler. The base muffler prevents an increase in the specific volume of the input refrigerant and causes smooth circulation of the refrigerant in the compressor. The present invention thus improves refrigerant compressing efficiency and refrigerating capacity of the compressor, and reduces the cost, and improves productivity of the compressor.

5 Claims, 8 Drawing Sheets

SUCTION MUFFLER ARRANGEMENT FOR A HERMETIC RECIPROCATING COMPRESSOR

BACKGROUND OF THE INVENTION

1. Field of the Invention

The present invention relates in general to a reciprocating compressor used for compressing gaseous refrigerant, coming out of an evaporator, thereby increasing the pressure and temperature of the refrigerant prior to supplying the refrigerant to a condenser in cooling mechanisms such as refrigerators and air conditioners.

2. Description of the Prior Art

U.S. Pat. No. 4,759,693 discloses an example of typical reciprocating compressors which are used for compressing gas refrigerant, coming out of an evaporator, thereby increasing the pressure and temperature of the refrigerant prior to supplying the refrigerant to a condenser in refrigerators or air conditioners. In the above U.S. reciprocating compressor, the refrigerant inlet passage is constructed such that it directly contacts with the cylinder cover. In this regard, the gaseous refrigerant is heated by the cylinder cover to a high temperature while it is introduced into the compressor through the inlet passage. In addition, the gaseous refrigerant is brought into direct contact with the cylinder cover, thus generating operational noise. In order to overcome the above problems, the above compressor includes a plastic housing and a suction nipple. The above plastic housing has first and second shells, while the suction nipple is formed of plastic material, having a thermal resistance higher than that of the shells, through extrusion.

Several types of compressors, which are suitable to prevent a possible increase in refrigerant's specific volume and improve productivity and reduce the cost of the compressor, have been actively studied and proposed recently.

FIGS. 1 and 2 show the construction of a representative example of the studied and proposed compressors suitable to achieve the above objects. As shown in these drawings, the compressor includes a hermetic casing 1 which tightly seals the interior of the compressor. Placed in the upper section inside the casing 1 is a motor unit which generates a rotating force. The motor unit includes a stator 3, which is fixed inside the above casing 1 and forms a magnetic field when it is applied with external electric power. The above motor unit also includes a rotor 5 which is placed inside the stator 3 and rotates by the magnetic field of the stator 3. The above compressor also includes a power transmitting unit which includes a crank shaft 7. The crank shaft 7 is tightly fitted in the center of the rotor 5 and extends downward so the shaft 7 rotates in accordance with the rotating motion of the rotor 5. The lower end of the above crank shaft 7 is coupled to one end of a connecting rod 9 which extends laterally. The above connecting rod 9 converts the rotating motion of the crank shaft 7 into a reciprocating motion of a piston 11 when the crank shaft 7 rotates by the rotating motion of the rotor 5. The above compressor further includes a refrigerant compressing unit. In the above compressing unit, the piston 11 is coupled to the other end of the connecting rod 9 and is received in a cylinder block 13 in order to reciprocate in the cylinder block 13 by the reciprocating motion of the connecting rod 9. The above cylinder block 13 guides the reciprocating motion of the piston 11 and defines a refrigerant compressing chamber. A valve plate 15 is mounted to one side of the cylinder block 13 thus forming the compressing chamber in cooperation with the piston 11. The above valve plate 15 is provided with refrigerant suction and exhaust ports 15*a* and 15*b*. The above compressing unit also includes a cylinder head 17 which is tightly mounted to the valve plate 15. The above cylinder head 17 has suction and exhaust chambers 17*a* and 17*b*.

A gasket 19 is interposed in the junction between the cylinder head 17 and valve plate 15 in order to seal the suction and exhaust chambers 17*a* and 17*b* of the cylinder head 17. The above cylinder head 17 is formed through casting.

A pair of first fitting through holes 17*c* are formed on the cylinder head 17, while a second fitting through hole 17*d* is formed on the head 17 between the above first holes 17*c* as shown in FIG. 2. The first and second fitting holes 17*c* and 17*d* communicate with the suction chamber 17*a* of the cylinder head 17. A thin steel pipe or a refrigerant suction pipe 21 is fitted in each first fitting hole 17*c*, while a plug 25 is fitted in the second fitting hole 17*d*. The above plug 25 in turn is coupled to a capillary tube 23.

The other ends of the above first fitting holes 17*c* are connected to a suction muffler 27 thus allow the suction muffler 27 to communicate with the suction chamber 17*a* of the cylinder head 17. The lower end of the capillary tube 23 is immersed in oil contained in an oil chamber 29.

In the operation of the above reciprocating compressor, the stator 3 forms a magnetic field when it is applied with external electric power. The rotor 5 is thus rotated by the magnetic field of the stator 3, thereby causing the crank shaft 7 to rotate at the same time. The rotating motion of the crank shaft 7 is converted into a reciprocating motion of the connecting rod 9. In accordance with the above reciprocating motion of the connecting rod 9, the piston 11 performs a linear reciprocating motion inside the cylinder block 13.

When the piston 11 in the above state moves in the direction shown in an arrow A of FIG. 1, a suction force is generated in the cylinder block 13. Due to the suction force, the gaseous refrigerant is sucked into the suction chamber 17*a* of the cylinder head 17 through the suction muffler 27 and refrigerant suction pipes 21. The refrigerant in turn is introduced into the cylinder block 13 through the suction port 15*a* of the valve plate 15.

Meanwhile, when the piston 11 moves in the direction shown in an arrow B of FIG. 1, an exhaust force is generated in the cylinder block 13. The high temperature pressurized refrigerant in the cylinder block 13 is thus exhausted to the exhaust chamber 17*b* of the cylinder head 17 through the exhaust port 15*b* of the valve plate 15.

During the above operation of the compressor, the gaseous refrigerant flowing in the suction pipes 21 is heated to a high temperature by the stator 3 and rotor 5 of the motor unit. In addition, the refrigerant in the suction chamber 17*a* of the cylinder head 17 is heated by the compressing heat which is generated by the compressing motion performed inside the cylinder block 13. In addition, the heat of the high temperature pressurized refrigerant which is exhausted to the exhaust chamber 17*b* is transferred to the refrigerant in the suction chamber 17*a* through the valve plate 15 and cylinder head 17.

Therefore, the refrigerant in the suction chamber 17*a* is saturated and becomes a high temperature saturated refrigerant. The specific volume of the refrigerant is thus increased in order to reduce the amount of circulating refrigerant and to reduce the compressing efficiency of the compressor. Due to the above reduced compressing efficiency, the refrigerating and energy efficiencies of the compressor are reduced.

In order to produce the above compressor, several soldering processes are required to fix the plug 25 fitted in the second fitting hole 17*d* of the cylinder head 17, the capillary tube 23 coupled to the above plug 25 and the suction pipes 21 fitted in the first fitting holes 17*c*. In addition, the gasket 19 is interposed in the junction between the valve plate 15 and cylinder head 17. Therefore, the above compressor increases the cost but reduces productivity.

SUMMARY OF THE INVENTION

It is, therefore, an object of the present invention to provide a structurally improved reciprocating compressor in which the above problems can be overcome and which prevents an increase in the specific volume of the refrigerant sucked into the cylinder block, thereby improving the compressing efficiency of the compressor.

It is another object of the present invention to provide a structurally improved reciprocating compressor which reduces the cost and improves productivity.

In order to accomplish the above objects, a reciprocating compressor in accordance with an embodiment of the present invention comprises a casing, a compressing means and a motor unit. The above compressing means includes a cylinder block defining a compressing chamber. A piston is received in the cylinder block in order to reciprocate in the cylinder block. The above compressing means is adapted for compressing low temperature and pressure refrigerant and increasing the temperature and pressure of the refrigerant thereby preparing high temperature pressurized refrigerant. The motor unit, which comprises a stator and rotor, is connected to the above piston by a crank shaft and connecting rod and generates a rotating force which is transferred to the piston through the crank shaft and connecting rod, thereby causing the piston to reciprocate in the cylinder block. The above compressor also includes a valve plate which is provided with suction and exhaust ports for sucking the low temperature and pressure refrigerant into the cylinder block and exhausting the high temperature pressurized refrigerant from the cylinder block respectively. A base muffler is mounted to the valve plate and adapted not only for acting as both a refrigerant suction pipe and gasket but also for preventing heat transfer. A cylinder head is mounted to the base muffler such that the base muffler is interposed between the valve plate and cylinder head. The above cylinder head includes two chambers, that is, fitting and exhaust chambers. The above fitting chamber of the cylinder head thermally insulates the refrigerant suction pipe of the base muffler from the heat of the motor unit. A suction muffler is assembled with the above base muffler in order to absorb operational noise generated from flow of the low temperature and pressure refrigerant. The above compressor further includes a capillary tube which communicates with the interior of the base muffler through the fitting chamber of the cylinder head. The above capillary tube is adapted for sucking oil into the base muffler.

In accordance with the above compressor, the base muffler prevents heat of the motor unit from being transferred to the low temperature and pressure refrigerant which has passed through the suction muffler. The above base muffler also prevents heat of the high temperature pressurized refrigerant from being transferred to the low temperature and pressure refrigerant, which has been sucked into the suction chamber, through the valve plate and cylinder head. The compressor thus prevents an increase in the specific volume of the refrigerant thereby increasing the amount of circulating refrigerant and improving the compressing efficiency. Since the above compressor is easily assembled and reduces the number of parts, the compressor saves the money and improves productivity.

BRIEF DESCRIPTION OF DRAWINGS

The above and other objects, features and advantages of the present invention will be more clearly understood from the following detailed description taken in conjunction with the accompanying drawings, in which.

DESCRIPTION OF THE PREFERRED EMBODIMENTS

Figure 1:
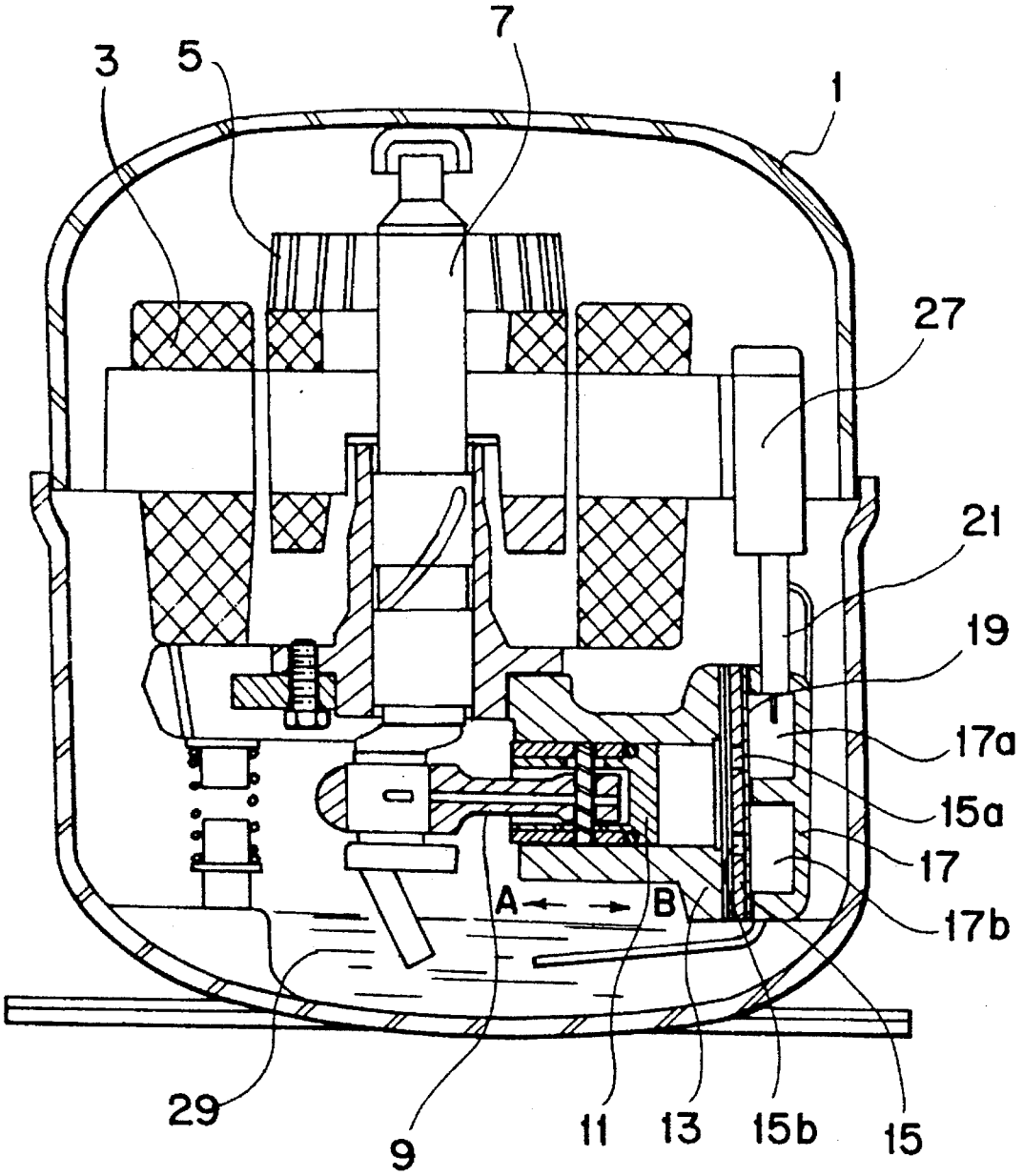
FIG. 1 (PRIOR ART)
FIG. 1 is a sectional view showing the construction of a typical reciprocating compressor.
Figure 2:
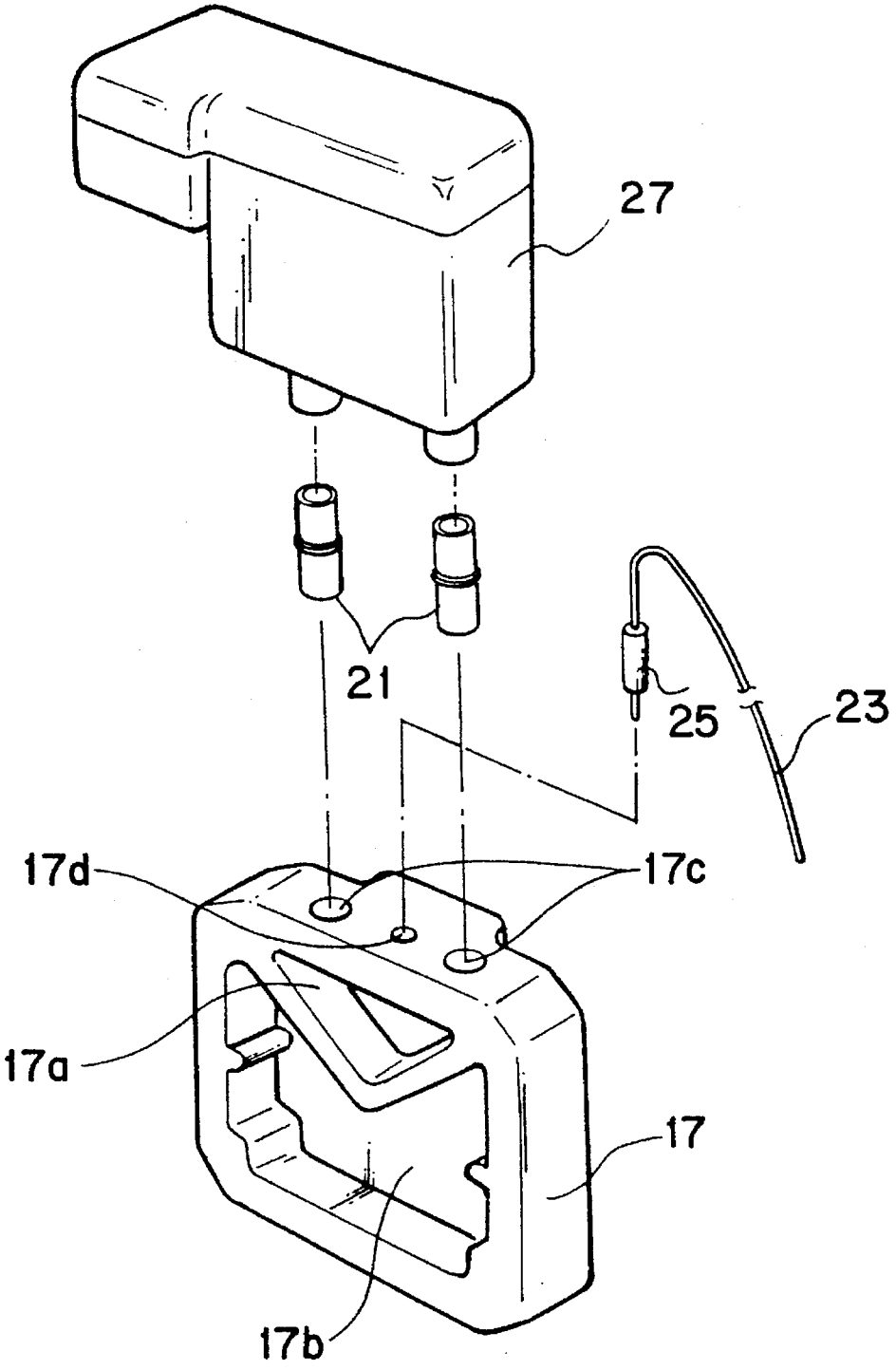
FIG. 2 (PRIOR ART)
FIG. 2 is an exploded perspective view showing the structure for connecting the cylinder head to a suction muffler of the above compressor.
Figure 3:
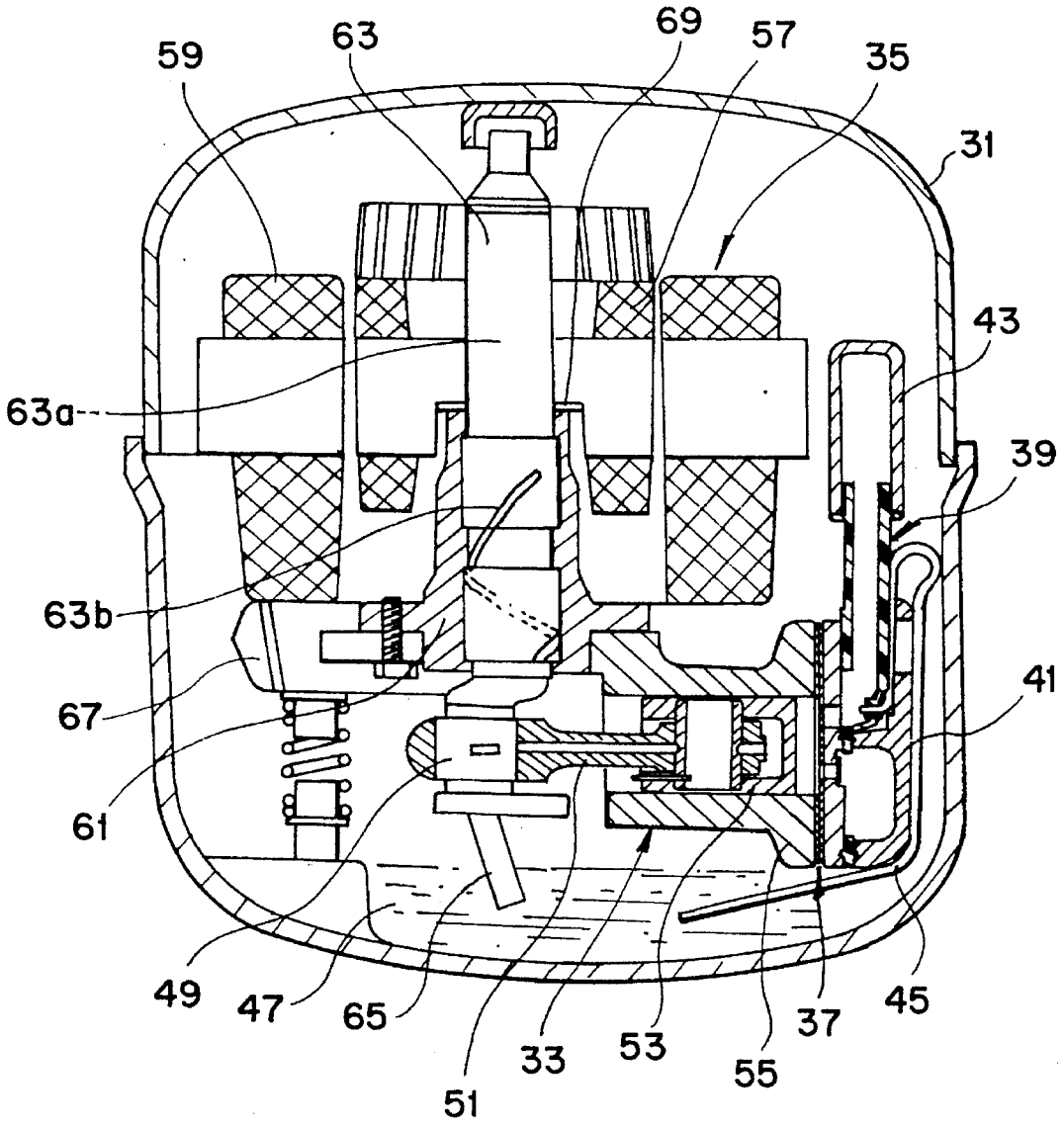
FIG. 3 is a sectional view showing the construction of a reciprocating compressor in accordance with a preferred embodiment of the present invention.

FIG. 3 is a sectional view showing the construction of a reciprocating compressor in accordance with an embodiment of the present invention. As shown in the drawing, the compressor of the present invention includes a compressing means 33 which compresses low temperature and pressure refrigerant, thus increasing the temperature and pressure of the refrigerant and preparing high temperature pressurized refrigerant. A motor 35 is provided in the upper section inside a compressor casing 31. The above motor 35 generates a rotating force which is transmitted to the above compressing unit 33 in order to generate a compressing force. The above compressor also includes a valve means 37 which is mounted to one side of the above compressing means 33. The valve means 37 not only guides the refrigerant which is sucked into and exhausted from the compressing means 33, it also controls the amount of the sucked and exhausted refrigerant. A base muffler 39 is mounted to one side of the above valve means 37. The base muffler 39 guides the refrigerant, which is sucked into or exhausted from the compressing unit 33 under the guide of the above valve means 37. Due to the above base muffler 39, the refrigerant is prevented from leaking and from being applied with heat. A cylinder head 41 is mounted to one side of the base muffler 39 and covers the above valve means 37. The cylinder head 41 guides the exhausted refrigerant in a predetermined direction. A suction muffler 43 is assembled with the top section of the above base muffler 39 in order to absorb operational noise generated from the flow of the low temperature and pressure refrigerant. In the above cylinder head 41, a capillary tube 45 extends to a base muffler 39 in order to introduce oil into the base muffler 39.

The other end of the above capillary tube 45 extends to an oil chamber 47 which is provided in the lower section of the compressor casing 31. The oil contained in the above oil chamber 47 is introduced into the base muffler 39 through the capillary tube 39.

Figure 4:
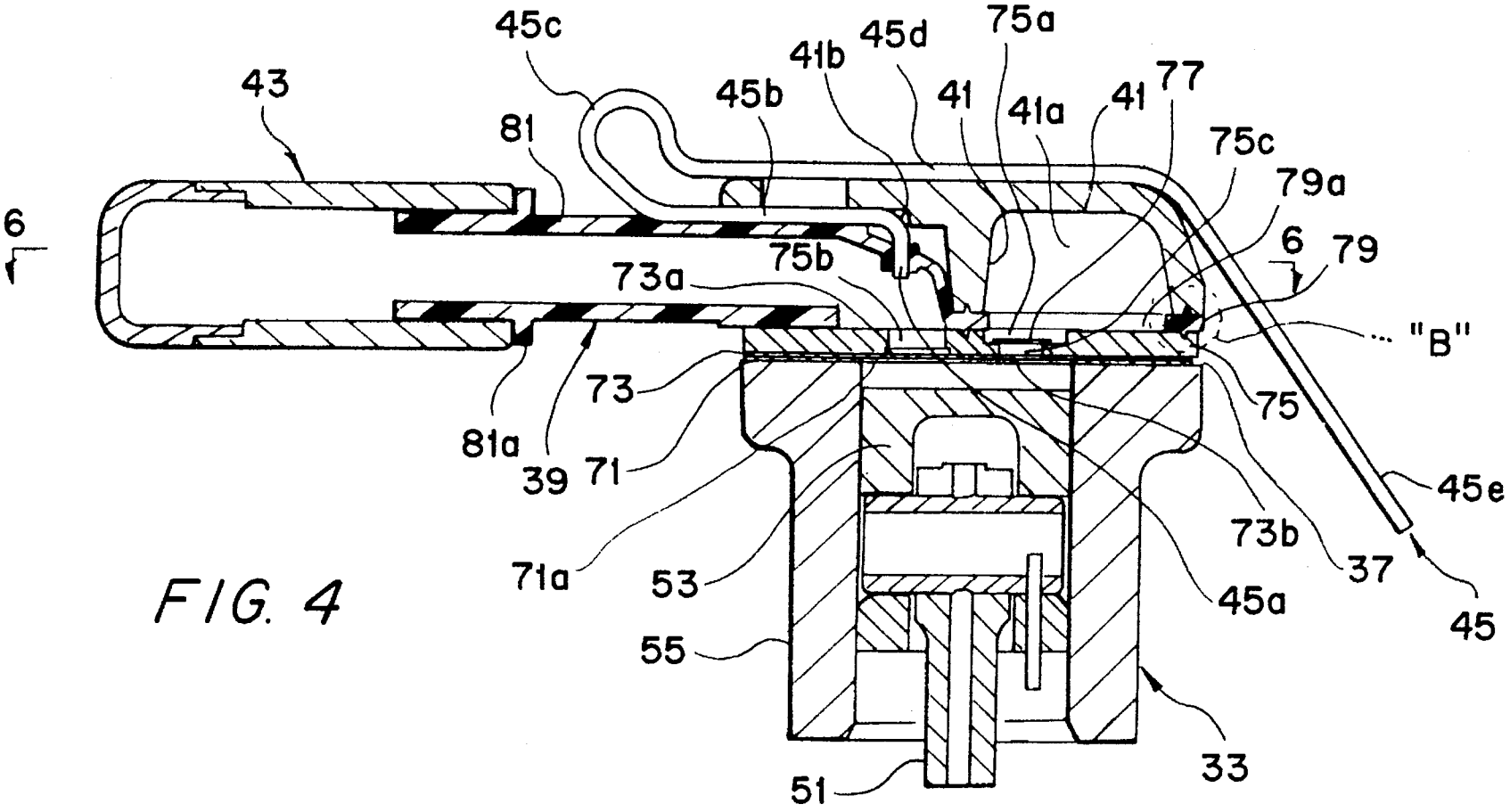
FIG. 4 is an exploded perspective view showing the structure for connecting the suction muffler to the compressing means of the compressor of FIG. 3.

In order to transmit the rotating force of the above motor 35 to the compressing means 33, an eccentric crank shaft 49 is connected to the center of the motor 35 as shown in FIGS. 3 and 4. The above crank shaft 49 thus rotates by the rotating force of the motor 35. The above crank shaft 49 is coupled to a connecting rod 51 by movably fitting the boss of the connecting rod 51 over the eccentric crank shaft 49. The connecting rod 51 thus converts the rotating motion of the crank shaft 49 into a reciprocating motion. A piston 53 is pivoted to the other end of the above connecting rod 51 by a pivot pin (not shown).

The above piston 53 is movably received in a cylinder block 55. The above cylinder block 55 guides the linear reciprocating motion of the piston 53 and defines a compressing chamber for compressing the refrigerant by the reciprocating motion of the piston 53 in the cylinder block 55.

The motor 35 includes a rotor 57. A rotating shaft 63 is tightly fitted in the above rotor 57 and is held by a bearing 61 thereby being rotated along with the rotor 57. The above motor 35 also includes a stator 59 which generates a magnetic field in order to rotate the rotor 57 when the stator 59 is applied with external electric power.

The crank shaft 49 is eccentrically mounted to the lower end of the above rotating shaft 63. An oil pick member 65 is mounted to the lower end of the above crank shaft 49 and picks up the oil contained in the oil chamber 47. In order to allow the oil, which is picked up by the member 65, to be lifted along the rotating shaft 63, a spiral groove **63*b* is formed in the center and on the outer surface of the rotating shaft 63 to the central portion of the crank shaft 49. The above rotating shaft bearing 61 and stator 59 are fixed to a frame 67. In order to allow the rotor 57 to be smoothly rotated, a thrust washer 69 is interposed between the bottom surface of the rotor 57 and the top surface of the bearing 61**.

The detailed construction of the valve means 37 is shown in FIG. 4. As shown in the drawing, the valve means 37 includes a gasket 71 which is tightly placed on the cylinder block 55 in order to prevent leakage of refrigerant. A suction valve 73 is placed on the gasket 71. The above valve 73 sucks the refrigerant into the cylinder block 55. The above valve means 37 also includes a valve plate 75 which is placed on the suction valve 73. The above valve plate 75 guides the refrigerant sucked into or exhausted from the cylinder block 55. An exhaust valve 77 is placed on the above valve plate 75.

As shown in FIG. 4, a through hole **71*a* is formed in the central portion of the gasket 71 in order to communicate with the interior of the cylinder block 55. The above suction valve 73 has a cutout portion having a predetermined configuration. A suction plate 73*a* is mounted to the above cutout portion of the suction valve 73 and acts as a suction valve. An exhaust port 73*b* is formed on one side of the above suction plate 73*a* and communicates with the exhaust valve 77**.

Figure 5:
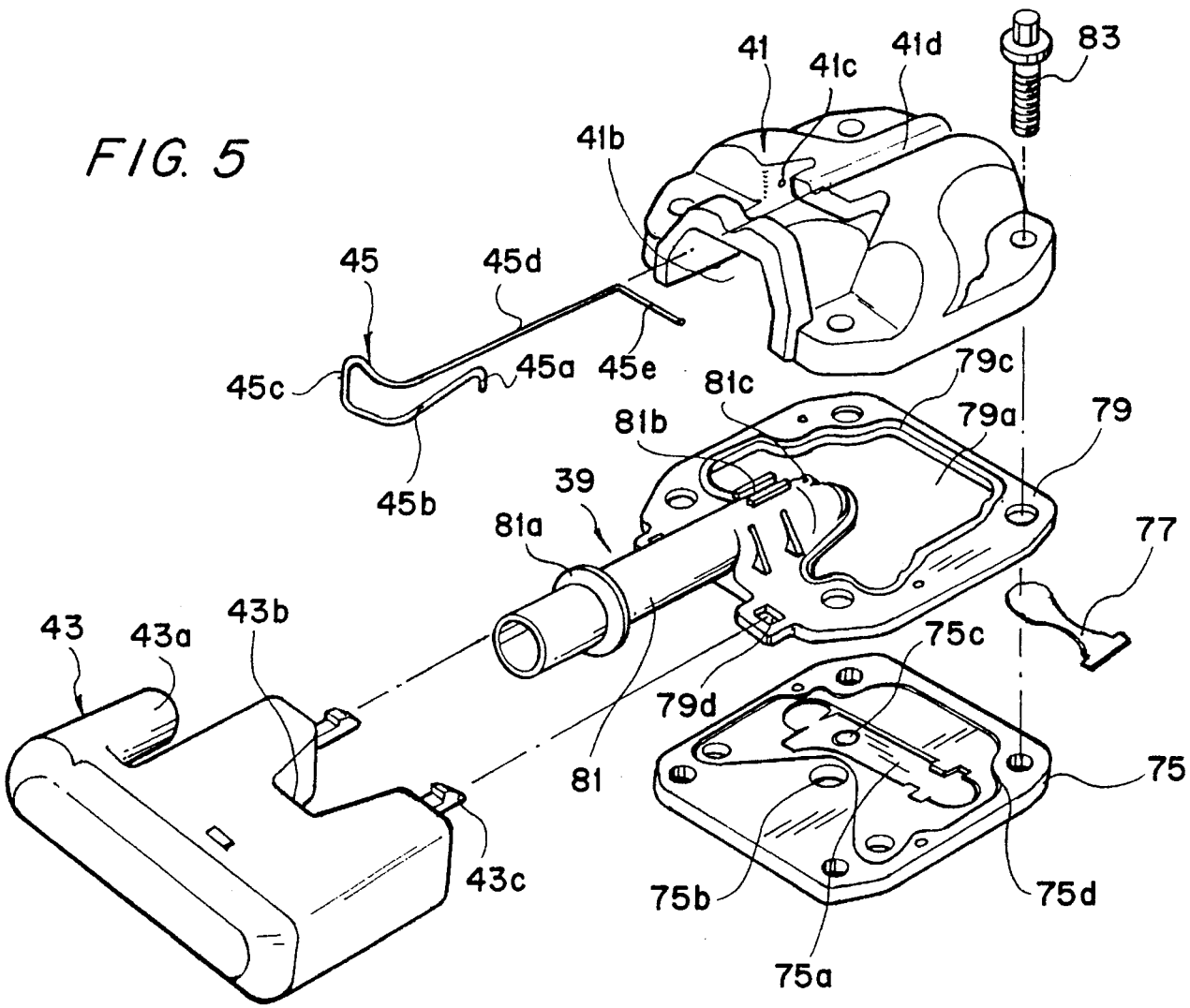
FIG. 5 is an exploded perspective view showing the construction of the compressing means and suction muffler of FIG. 4 in detail.

The above valve plate 75 is provided with a longitudinal depression **75*a* as shown in FIGS. 4 and 5. The exhaust valve 77 is set in the above depression 75*a* of the plate 75. The suction plate 73*a* of the suction valve 73 is formed in the above depression 75*a*. The above depression 75*a* also includes suction and exhaust ports 75*b* and 75*c* which communicate with the exhaust valve 77. A ditch 75*d* having a predetermined depth is formed on one side of the above valve plate 75, thus forming a grooved closed curve on the plate 75**.

Figure 7A:
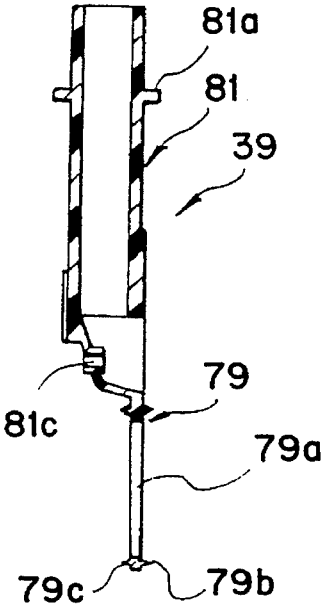
FIGS. 7A and 7B are sectional and side views of the base muffler of FIG. 4, respectively.
Figure 7B:
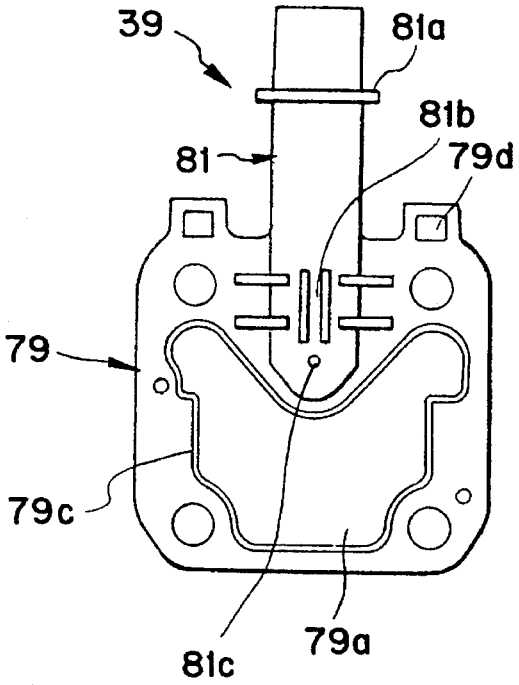

As shown in FIGS. 4, 7A and 7B, the base muffler 39 has a gasket part 79 and a refrigerant suction pipe part 81 which are integrated into a single body. The above gasket part 79 tightly contacts with the valve plate 75. Due to the gasket part 79, heat generated during the compressing operation of the cylinder block 55 is prevented from being transferred to the low temperature and pressure refrigerant. The gasket part 79 also prevents the leakage of refrigerant. The suction pipe part 81 guides the refrigerant to the suction port **75*b* of the valve plate 75**.

Figure 8:
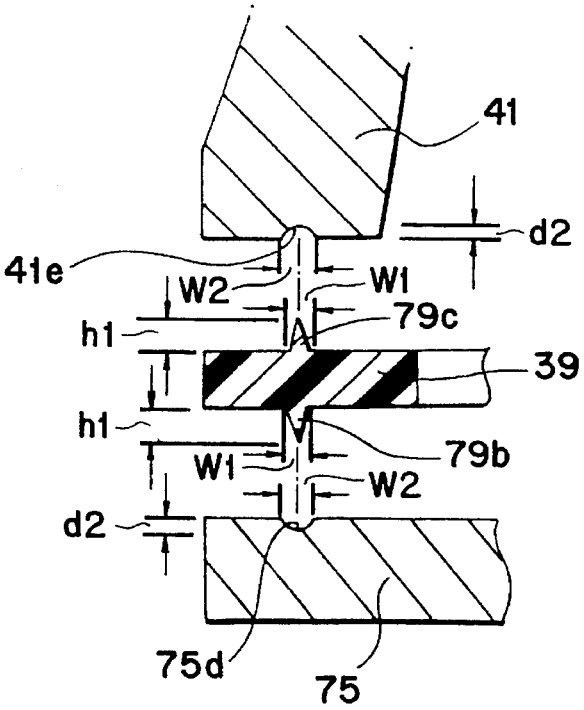
FIG. 8 is a partially enlarged sectional view showing the construction of the circled portion B of FIG. 4.

As shown in FIGS. 7A, 7B and 8, the gasket part 79 of the base muffler 39 is provided with a noncircular opening **79*a* which communicates with an exhaust chamber of the cylinder head 41. The above exhaust chamber 41*a* of the cylinder head 41 will be described later herein. A dam 79*b* or 79*c* is formed on each side of the gasket part 79 around the edge of the opening 79*a* in order to form a closed curve. The above dams 79*b* and 79*c* engage with ditches 75*d* and 41*e* of the valve plate 75 and cylinder head 41 respectively, thereby preventing the leakage of refrigerant. The ditch 41*e* of the cylinder head 41 will be described later herein. The gasket part 79 also includes a pair of snap holes 79*d* into which a pair of snap hooks 43*c* of the suction muffler 43 are snapped when the base muffler 39 is coupled to the suction muffler 43**.

A stop flange **81*a* is formed on the outer surface of the suction pipe part 81 of the above base muffler 39. The stop flange 81*a* contacts with the suction muffler 43 when one end of the suction pipe part 81 is fitted into the muffler 43 in order to couple the base muffler 39 to the suction muffler 43. The configuration of the other end of the suction pipe part 81 is streamlined. At the above streamlined end, the suction pipe part 81 is integrated with the gasket part 79 into the base muffler 39. In order to tightly fit the capillary tube 45 to the base muffler 39, a fitting groove 81*b* is axially formed on the central portion of the outer surface of the above streamlined end. In addition, the above streamlined end is radially perforated in order to form a through hole 81*c* having a predetermined diameter. One end of the capillary tube 45 is fitted in the above through hole 81*c* and communicates with the interior of the suction pipe part 81**.

In the present invention, the base muffler 39 is preferably formed of a plastic material having a low heat conductivity in order to minimize the amount of transferred heat.

In the above cylinder head 41, the interior of the cylinder head 41 is divided into two chambers, that is, the exhaust and fitting chambers **41*a* and 41*b*, by a partition 41*c*. The above exhaust chamber 41*a* of the cylinder head 41 communicates with the depression 75*a* of the valve plate 75, while the fitting chamber 41*b* receives the suction pipe part 81 of the base muffler 39. A fitting groove 41*d* is formed on the top surface of the cylinder head 41 as shown in FIG. 5. The capillary tube 45 is fitted in the above fitting groove 41*d* of the cylinder head 41. The ditch 41*e* of the cylinder head 41, which engages with the top dam 79*c* of the base muffler 39 as described above, is formed on the bottom edge of the cylinder head 41. The above ditch 41*e* has a predetermined depth and forms a grooved closed curve on the bottom edge of the cylinder head 41**.

The dams 79*b* and 79*c* of the gasket part 79 of the base muffler 39 and the ditches 75*d* and 41*e* engaging with the above dams 79*b* and 79*c* are designed as follows. As shown in FIG. 8, the dams 79*b* and 79*c* of the gasket part 79 must closely contact with the ditches 75*d* and 41*e* when the dams engage with the ditches so the bottom width W1 of each dam 79*b* or 79*c* is designed to be smaller than the width W2 of each ditch 75*d* or 41*e*. In addition, the height h1 of each dam 79*b* or 79*c* is designed to be higher than the depth d2 of each ditch 75*d* and 41*e*.

As shown in FIG. 5, the suction muffler 43 includes a suction part 43*a* which sucks the low temperature and pressure refrigerant into the muffler 43. The above muffler 43 also includes a pipe fitting part 43*b* which receives the suction pipe part 81 of the base muffler 39 and guides the low temperature and pressure refrigerant to the suction pipe part 81. The muffler 43 further includes the snap hooks 43*c* which are snapped into the snap holes 79*d* of the gasket part 79 when the base muffler 39 is coupled to the suction muffler 43.

Figure 9:
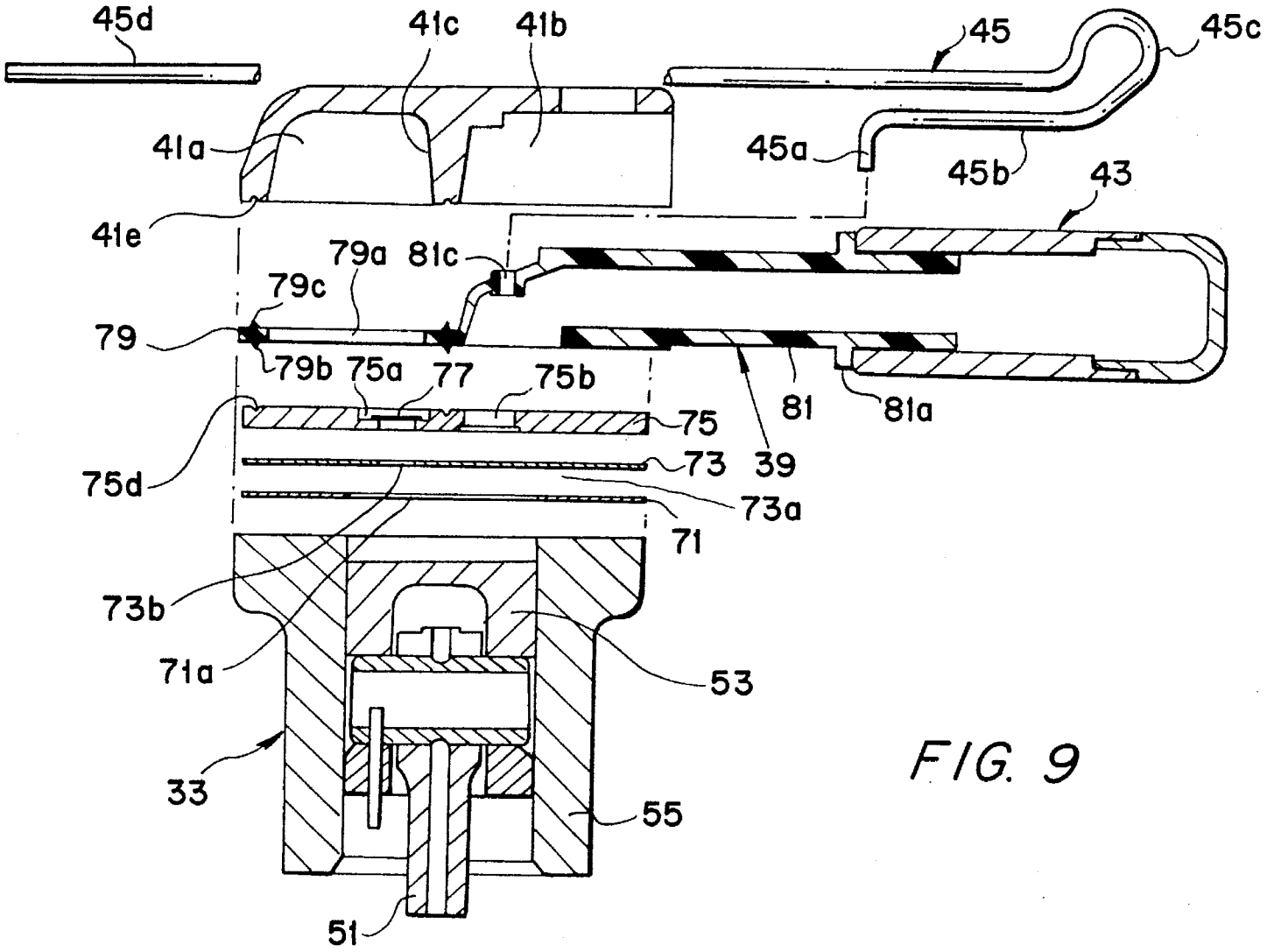
FIG. 9 is an exploded sectional view showing the order of assembling the cylinder block, gasket, suction valve plate, base muffler, cylinder head, capillary tube and suction muffler of FIG. 4.

The construction of the above capillary tube 45 is shown in FIGS. 5 and 9 in detail. As shown in the drawings, one end of the capillary tube 45 is bent in order to form a bent end part 45*a* which is inserted in the through hole 81*c* of the base muffler 39. A first linear part 45*b* extends from the above bent end part 45*a*. The above first linear part 45*b* is fitted in the fitting groove 81*b* of the base muffler 39 thereby holding the capillary tube 45 on the base muffler 39. A bent part 45*c* extends from the above first linear part 45*b* in order to give a predetermined elasticity to the capillary tube 45. The above bent part 45*c* has a predetermined configuration. A second linear part 45*d* extends from the above bent part 45*c*. The above second linear part 45*d* is fitted in the fitting groove 41*d* of the cylinder head 41. The other end of the above capillary tube 45 is bent from the above second linear part 45*d* thereby forming a third linear part 45*e*. The third linear part 45*e* is partially immersed in the oil contained in the oil chamber 47.

In the above compressor, the cylinder block 55, valve means 37, base muffler 39, gasket part 79 and cylinder head 41 are assembled together into the compressing means 33 by a plurality of screws 83.

The above parts of the compressor are assembled together into the compressor in the following manner.

Primarily, the gasket 71, suction valve 73 and valve plate 75 are orderly laid on one side of the cylinder block 55.

Thereafter, the bent end 45*a* of the capillary tube 45 is tightly fitted in the through hole 81*c* of the base muffler 39 in order to communicate with the suction pipe part 81 of the base muffler 39. In the case, the first linear part 45*b* of the capillary tube 45 is fitted in the fitting groove 81*b* of the base muffler 39 thus holding the tube 45 on the muffler 39.

After fitting the above capillary tube 45, the cylinder head 41 is placed on the valve plate 75 while interposing the gasket part 79 of the base muffler 39 between the cylinder head 41 and valve plate 75. The above cylinder head 41 in turn is airtightly fixed to the cylinder block 55 by tightening the plurality of screws 83, thus holding the valve means 37, base muffler 39 and gasket part 79 in their places between the cylinder block 55 and cylinder head 41. In the above state, the bottom dam 79*b* of the gasket part 79 is tightly received in the ditch 75*d* of the valve plate 75, while the top dam 79*c* of the gasket part 79 is tightly received in the ditch 41*e* of the cylinder head 41 as shown in FIG. 9. The contact portion where the bottom surface of the base muffler's gasket part 79 tightly contacts with the top surface of the valve plate 75 is shown by the hatched portion C of FIG. 6. The second linear part 45*d* of the capillary tube 45 is fitted into the fitting groove 41*d* of the cylinder head 41. The second linear part 45*d* of the above capillary tube 45 is bent in order to form the third linear part 45*e* which extends to the oil chamber 47.

Figure 6:
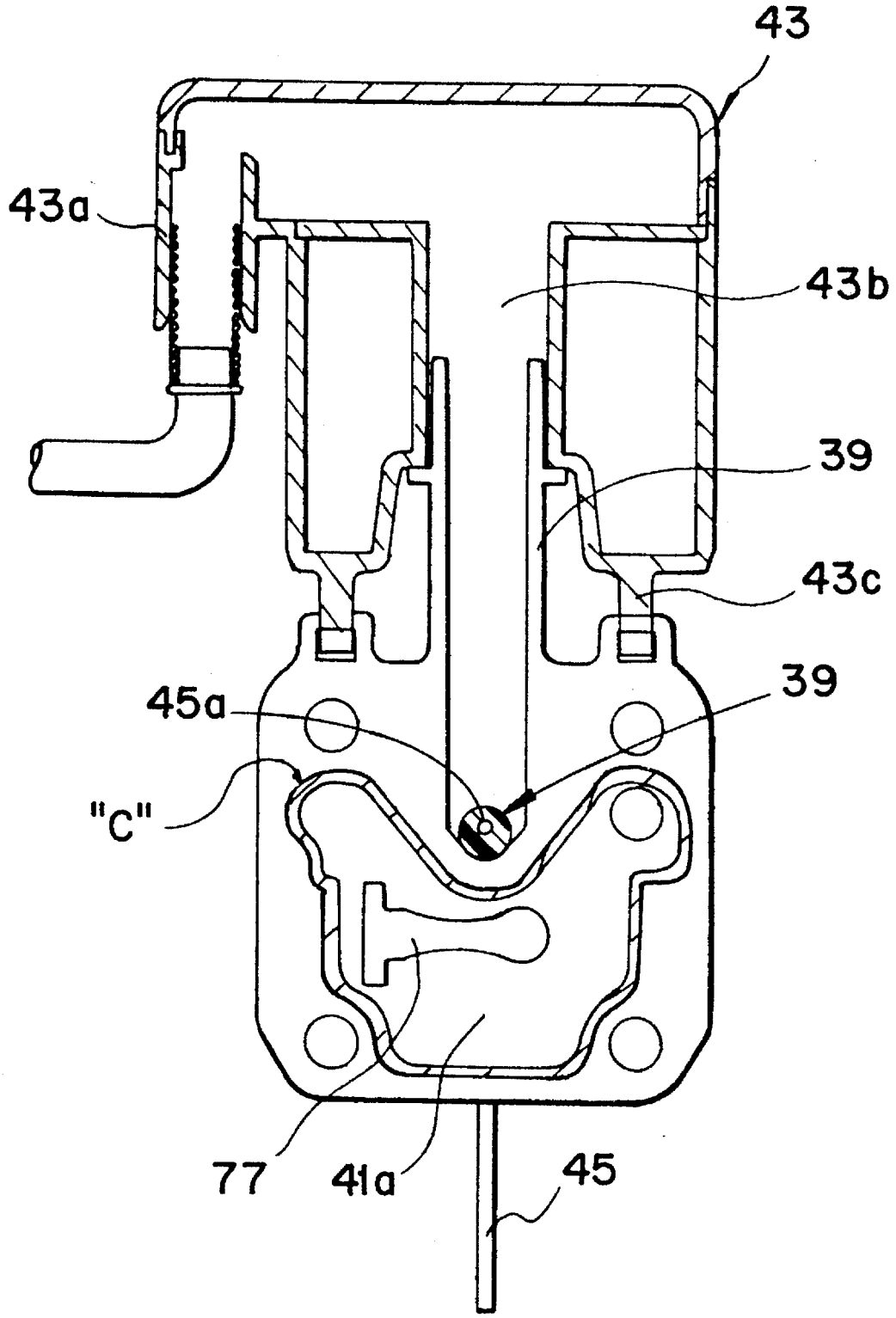
FIG. 6 is a sectional view taken along the section line 6—6 of FIG. 4, showing the structure for connecting the suction muffler to a base muffler.

After assembling the above compressing means, the vacuum of the assembled compressing means 33 is checked. After checking the vacuum of the compressing means 33, the suction muffler 43 is coupled to the assembled compressing means 33 as shown in FIGS. 6 and 9. In order to couple the suction muffler 43 to the compressing means 33, the suction pipe part 81 of the base muffler 39 is tightly fitted into the pipe fitting part 43*b* of the suction muffler 43, while the above snap hooks 43*c* are snapped into the snap holes 79*d* (FIG. 5) of the base muffler 43. At this time, the stop flange 81*a* formed on the suction pipe part 81 of the base muffler 39 closely faces the step formed on the mouth of the pipe fitting part 43*b* of the suction muffler 43. Therefore, the suction muffler 43 is tightly coupled to the base muffler 39.

The operational effect of the above compressor will be described hereinbelow.

In the operation of the above compressor, the stator 59 of the motor 35 forms a magnetic field when it is applied with external electric power from an external power source (not shown). The rotor 57 of the motor 35 is rotated by the magnetic field of the above stator 59. The rotating force of the rotor 57 is transmitted to the eccentric crank shaft 49 through the rotating shaft 63 thereby rotating the above crank shaft 49.

The rotating motion of the crank shaft 49 in turn is converted into a reciprocating motion of the connecting rod 51. In accordance with the reciprocating motion of the above connecting rod 51, the piston 53 coupled to the rod 51 reciprocates inside the cylinder block 55.

During the above reciprocating motion of the piston 53 in the cylinder block 55, a suction force is generated in the compressor casing 31. Therefore, low temperature and pressure refrigerant is forcibly introduced into the compressor casing 31 and in turn flows into the suction muffler 43 through the suction part 43*a* of the muffler 43. Thereafter, the low temperature and pressure refrigerant orderly passes the suction pipe part 81 of the base muffler 39, suction port 75*b* of the valve plate 75 and suction plate 73*a* of the suction valve 73, thereby being introduced into the cylinder block 55.

In the above state, neither the heat generated from the rotor 57 and stator 59 of the motor 35 nor the heat generated from the compressing operation of the cylinder block 55 is transferred to the low temperature and pressure refrigerant flowing in the suction pipe part 81 of the base muffler 39. This is because the base muffler 39 is formed of a plastic material having lower heat conductivity.

Therefore, it is possible to prevent an increase in the specific volume of the input refrigerant which is introduced into the cylinder block 55 through the above suction pipe part 81. The refrigerant compressing efficiency of the above compressor is thus improved.

As the compressor of this invention reduces the specific volume of the low temperature and pressure input refrigerant, the compressor achieves smooth circulation of the refrigerant. The amount of the circulating refrigerant is thus increased in order to improve the refrigerant compressing efficiency of the compressor and to improve the refrigerating capacity of a refrigerating system.

In the above compressor, the above base muffler 39 is constructed in order to commonly act as a gasket and refrigerant suction pipe. In addition, the suction muffler 43 is tightly coupled to the base muffler 39 since the snap hooks 43*c* of the suction muffler 43 is tightly snapped into the snap holes 79*d* of the base muffler 39. Therefore, the suction muffler 43 is effectively prevented from moving during the operation of the compressor. The compressor of this invention also reduces the number of the parts and is easily assembled, thus reducing the cost and improving productivity.

During the operation of the above compressor, the oil contained in the oil chamber 47 is smoothly supplied to the interior of the cylinder block 55 through the capillary tube 45 due to the reciprocating motion of the piston 53 in the cylinder block 55. An oil film is thus formed between the piston 53 and cylinder block thereby effectively lubricating and cooling the frictional contact parts between the piston 53 and cylinder block 55 during the operation of the compressor.

In addition, the bottom width W1 of each dam 79*b* or 79*c* of the base muffler's gasket part 79 is designed to be smaller than the width W2 of each ditch 41*e* or 75*d*, while the height h1 of each dam 79*b* or 79*c* is designed to be higher than the depth d2 of each ditch 41*e* or 75*d*. The above ditches 41*e* and 75*d* are formed on the cylinder head 41 and valve plate 75 respectively. In this regard, the width W1 of the above dams 79*b* and 79*c* is increased, while the height h1 of the dams 79*b* and 79*c* is reduced when the dams 79*b* and 79*c* tightly engage with the ditches 75*d* and 41*e*. The dams 79*b* and 79*c* are thus brought into tight contact with the ditches 75*d* and 41*e*.

It is thus possible to prevent the pressurized output refrigerant in the pressurized exhaust chamber 41*a* of the cylinder head 41 from being leaked.

In the capillary tube 45, the bent part 45*c* gives elasticity to the first and second linear parts 45*b* and 45*d*. The capillary tube 45 is free from operational vibrations and noises caused by the vibrations.

As described above, the reciprocating compressor of the present invention has a base muffler which acts not only as a refrigerant suction pipe and gasket but also as a means for preventing heat from being transferred to the input refrigerant having low temperature and pressure. The above base muffler is interposed between a valve means and cylinder head. Due to the base muffler, it is possible to almost prevent the motor heat and compressing heat from being transferred to the input refrigerant passing the suction pipe part of the base muffler. The motor heat is generated from the rotor and stator of a motor, while the compressing heat is generated from the compressing operation performed in the cylinder block. Therefore, the above base muffler prevents an increase in the specific volume of the input refrigerant and causes smooth circulation of the refrigerant in the compressor. The present invention thus improves refrigerant compressing efficiency and refrigerating capacity of the compressor, and reduces the cost, and improves productivity of the compressor.

The foregoing description of the preferred embodiment has been presented for the purse of illustration and description. It is not intended to limit the scope of this invention. Many modifications and variations are possible in light of the above teaching. It should be understood that the present invention can be applied to all kinds of the apparatus within the scope of the above presentation.

What is claimed is:

1. A reciprocating compressor comprising a closed and sealed compressor casing, drive means with stator and rotor, and a cylinder block defining a refrigerant compressing chamber and adapted for guiding the reciprocating motion of a piston movably received in the cylinder block, further comprising:

a valve plate with suction and exhaust ports;

a base muffler mounted to said valve plate, said base muffler having:

a gasket part tightly contacting with said valve plate and adapted not only for preventing heat generated during a compressing operation of the cylinder block from being transferred but also for preventing leakage of refrigerant; and a refrigerant suction pipe part integrated with said gasket part into a single body base muffler, said suction pipe part being adapted for guiding the refrigerant to the suction port of said valve plate;

a cylinder head mounted to said base muffler, said cylinder head having:

a partition for dividing the interior of said cylinder head into a refrigerant exhaust chamber and fitting chamber;

a fitting groove formed on a top surface of said cylinder head and adapted for fitting a capillary tube; and a ditch formed on a bottom surface of the cylinder head and adapted for engaging with a dam of said gasket part of the base muffler in order to prevent leakage of the refrigerant;

a suction muffler coupled to said base muffler, said suction muffler having:

a suction part adapted for sucking the refrigerant into said suction muffler;

a pipe fitting part tightly receiving the suction pipe part of the base muffler and adapted for guiding the refrigerant to said suction pipe part of the base muffler; and a snap hook snapped into a snap hole of said base muffler thereby coupling the suction muffler to the base muffler;

a capillary tube communicating with the interior of said base muffler through the fitting chamber of the cylinder head thereby sucking oil into the base muffler.

2. The reciprocating compressor according to claim 1, wherein said base muffler is formed of a plastic material having a low heat conductivity.

3. The reciprocating compressor according to claim 1, wherein said capillary tube comprises:

a bent end part inserted into a through hole of said base muffler in order to connect the tube to the base muffler;

a first linear part extending from said bent end part and being fitted in the suction pipe part of said base muffler in order to hold the tube on the base muffler;

a bent part extending from said first linear part and being bent into a predetermined configuration suitable to give a predetermined elasticity to said tube;

a second linear part extending from said bent part and being fitted in the fitting groove of said cylinder head in order to hold the tube on the cylinder head; and a third linear part extending and bent from said second linear part, said third linear part being immersed in oil contained in an oil chamber of the compressor casing.

4. The reciprocating compressor according to claim 1, wherein said gasket part of the base muffler is provided with top and bottom dams on its both sides, said dams engaging with ditches of both the cylinder head and the valve plate, respectively, thereby preventing leakage of the refrigerant.

5. The reciprocating compressor according to claim 4, wherein each of said dams has a bottom width smaller than a width of each ditch and has a height higher than a depth of each ditch, thereby being brought into close contact with each ditch when the dams engage with the ditches.

* * * * *